United States Patent [19]

Chiama

[11] Patent Number: 4,558,942

[45] Date of Patent: Dec. 17, 1985

[54] VERY HIGH SPEED DUPLICATOR WITH FINISHING FUNCTION FOR DUPLEX COPYING DOING IMMEDIATE INVERSION OF COPY SHEETS

[75] Inventor: Bernard A. Chiama, Penn Yan, N.Y.

[73] Assignee: Xerox Corporation, Stamford, Conn.

[21] Appl. No.: 564,585

[22] Filed: Dec. 22, 1983

[51] Int. Cl.[4] ..... G03G 15/00; B65H 39/10

[52] U.S. Cl. ..... 355/14 SH; 355/24; 355/3 SH; 271/287; 270/53

[58] Field of Search ..... 355/3 R, 3 SH:14 SH, 355/14 R, 14 C, 14 E, 23, 24, 26; 271/303, 305; 270/53; 414/43, 52–54

[56] References Cited

U.S. PATENT DOCUMENTS

| | | | |
|---|---|---|---|
| 3,506,347 | 4/1970 | Carlson | 355/3 |
| 3,997,263 | 12/1976 | Stemmle | 271/303 X |
| 4,062,061 | 12/1977 | Batchelor et al. | 364/900 |
| 4,134,672 | 1/1979 | Burlew et al. | 355/14 |
| 4,158,500 | 6/1979 | DiFrancesco et al. | 355/14 |
| 4,176,945 | 12/1979 | Holzhauser et al. | 355/23 |
| 4,192,607 | 3/1980 | Hage | 355/50 |
| 4,264,183 | 4/1981 | Stoudt | 355/3 R |
| 4,328,919 | 5/1982 | Lawrence et al. | 227/155 |
| 4,361,393 | 11/1982 | Noto | 355/3 SH |
| 4,411,517 | 10/1983 | Gerken | 355/14 SH |
| 4,412,740 | 11/1983 | Buddendeck et al. | 355/3 SH X |
| 4,431,303 | 2/1984 | Hoffman | 355/3 SH |

OTHER PUBLICATIONS

Research Disclosure Bulletin, No. 19015, p. 61, Feb. 1980.

Research Disclosure Bulletin, Nos. 22733 and 22734, pp. 120–134, Mar. 1983.

*Primary Examiner*—R. L. Moses

*Assistant Examiner*—C. Romano

*Attorney, Agent, or Firm*—Bernard A. Chiama

[57] ABSTRACT

A document handling apparatus/copy sheet processor/finishing apparatus arranged as an integrated system to produce bound copy sheets at high speed but with minimum mechanical activity by double exposing one or both sides of a document sheet, producing side-by-side copy sheets in accordance with either of the exposures modes, distributing the successive copy sheets alternately into receiving trays and utilizing a set transport for each of the trays to bring copy sets alternately to a single point binding device.

9 Claims, 6 Drawing Figures

11
12
14
15
18
19
24
25
26
27
28
29
30
31
32
33
34
36
37
39
40
50
51
55
65
100
P
D
S

VERY HIGH SPEED DUPLICATOR WITH FINISHING FUNCTION FOR DUPLEX COPYING DOING IMMEDIATE INVERSION OF COPY SHEETS

This invention relates to an improved copying/finishing system by incorporating a novel sequencing arrangement of document handling and finishing to affect very high speed copy set production by way of high productivity.

With the advent of higher speed and more sophisticated copy producing machines, printing presses, and the like, considerations as to how the mass of copies generated can best and most effectively be handled, has assumed increasing importance. One way has been to provide a reproduction system with an input device in the form of a recirculating document handling apparatus. In this system, a document sheet is removed from a collated set of document sheets, placed on an exposure platen for exposure at the rate of one exposure for each document sheet, and returned to the top of the set in the document handling apparatus until the set of document sheets has been completely circulated through the apparatus, and a completed, collated copy set has been produced. The set of document sheets is then recycled for the reproduction of a second copy set, and so on. After each copy set is produced and collected at a collection station, an attaching device such as a stapler or stitcher may be activated to bind the set. In more recent considerations in copy systems has been the use of adhesive binders for finishing whereby collated sets are bound along one edge by an adhesive material. Therefore, for the description below of the art and the present invention, it will be understood that the generic term "finishing" will include such copy sheet attachment or binding as produced by stapling, stitching and adhesive binding.

Generally, these systems are of the pre-collation type wherein the document sheets are loaded in collated order into the document handling apparatus prior to commencement of a reproduction run. The output for the reproduction machine will likewise be precollated in sets corresponding to the sequenced numbered document set in the document handling apparatus. The copy sheets are collected in collated sets, one set at a time at a single collection point as they are sequentially produced so that binding may be effected without the interaction of additional devices. Such systems are described in U.S. Pat. No. 4,134,672.

One of the disadvantages of the pre-collation type systems having continuous document recirculation to produce a bound copy set at a time is that present day document handling apparatus have lower reliability when handling document sheets at very high speeds such as, at the rate of 120 or more copy impressions per minute for which their host copiers are adapted. Document sheet handling at these rates could result in physical damage after a number of recirculations. Further, the compilation of each copy set and eventual stapling or stitching, would require complex mechanisms which increases the risk of unscheduled maintenance. In addition, generally, in providing for the finishing step such as stapling, stitching, or adhesive binding one or more machine pitches per set may be lost thereby reducing productivity for the system. For example, the time period for removing a document sheet from the exposure platen by the document handling apparatus and to place another sheet thereon and in proper registration, or in manipulations to copy both sides of a document sheet sequentially, may be such that an entire machine pitch, or copy cycle may be lost. Consequently, either a slower copy processor speed must be employed or only a lesser number of machine pitches can be utilized to produce a copy sheet. In other words, in commercial machines presently in use, the maximum speeds for reliable copy processing is higher than the maximum speed of reliable document handling in a recirculating type apparatus and in finishing collated copy sets.

In a so called "immediate" duplex system such as that shown in U.S. Pat. Nos. 4,158,500; 4,176,945; and 4,192,607, duplex document sheets are copied on one side and then are immediately moved from the platen to be turned over (or inverted) and immediately returned to the platen for copying the opposite side of each document after copying the first side. This must be done for each duplex document sheet in each circulation of a document set to provide precollated output copies. This system requires very rapid handling of each document sheet in a small arcuate path within a short time period corresponding to one machine copy cycle or pitch for the copier. If this cannot be done, then at least one pitch of the copier must be skipped for each said duplex document sheet handling step, i.e. the copier controller is programmed to copy one side of each document sheet in one step in one pitch, skip a pitch while the document sheet is being inverted and returned, copy the other side of the document sheet with the next pitch, copy the first side of the next document sheet, skip a pitch while inverting this second document sheet, copy the opposite side of that second document sheet, and so on. It may be seen that this undesirably reduces the effective copy rate of the copier by one third for duplex document sheets to duplex copy sheets mode of operation. Additional pitches are lost if each document sheet, afer side two is exposed, is re-inverted before returned to the stack of document sheets. Such operation also requires a different copying sequence for the machine programmer for duplex document sheets than for simplex document sheets with different actuations of the inner document or pitch fadeout lamps or the like to prevent contamination of the photoreceptor in the skipped pitches between document images.

Very high speed copy set production may be achieved in a system of the post-collation type wherein each document sheet is exposed for a relatively high number of times, for example, ten or twelve times before the next document sheet is similarly exposed, and so on. A sorter array having a number of bins equal to the number of exposures collate the collected sets and a set transport is arranged to remove each collected set from the bins and to transport them to a stapler device. A typical example of a post-collation type duplicator system is disclosed in U.S. Pat. No. 4,444,491. These systems are rather cumbersome, requiring many additional hardware components, space and attention, and not readily efficient for a small number of copy sets.

In order to achieve higher rates of production of finished copy sets using a recirculating document handler in a very high speed copier, and the finishing collated copy sets, the present invention, utilizes pre-collation with dual exposures per document sheet side. The present invention utilizes recirculating document handling wherein two images are produced for each side of a document sheet, say for example, of page one of a multi-page document, before a successive document sheet, or perhaps page two of the document sheet if the duplex mode has been selected, is likewise imaged. This sequencing of producing dual images in turn may be repeated additional times if a larger number of copy sets are to be reproduced. In this aspect of the invention, the mechanical movements involved in document handling are reduced and yet maximum throughput at very high speeds can be achieved.

In the present invention, the copy sheets produced in accordance with the above imaging procedure, are collected in a pair of collecting trays by means of a sheet transport and one or more diverter gate(s) arranged to alternately deliver sheets to each of the trays.

At the instant a first copy set is completed, such as when the last copy sheet of the document is delivered to its designated tray, the copy set is removed from the collecting tray by means of a set transport positioned on the end of the tray opposite that to which the sheets are delivered. This action occurs even as the last copy sheet is being delivered to the other tray. For binding purposes the set transport conveys the copy set to a single finishing station whereat a finishing device such as one or more stitchers, staplers or adhesive binders positioned adjacent the set transport and activated to apply one or more staples to each completed set, or to effect adhesive edge binding. At the instant the second copy set is completed, a second set transport is actuated to remove this set and to convey the same to either the same or to a second stitcher, stapler, or adhesive binder. This action occurs as the first copy sheet of still another copy set is being delivered to the first tray. In this arrangement, copy sets are brought to a single point for binding by two set transports working in conjunction with two collating bins.

In its total system, therefore, the present invention takes advantage of some of the best features of both precollation and post-collation in a mutally complimentary manner. By the same token, the disadvantages specific to each of these forms of document handling/-finishing has been minimized or eliminated.

Except for the modifications described herein in accordance with the present invention, the same is particularly adapted for incorporation into present day machines on the market, such as the Xerox duplication machines labeled the 9400® Duplicator and the 9500® Duplicator marketed by Xerox Corporation of Stamford, Conn. Such machines are disclosed in U.S. Pat. No. 4,062,061, and is herein incorporated by reference. These machines utilize full frame, flash exposure of a document sheet placed on an exposure platen. However, any other copying machine may be utilized which employs full frame, flash exposure on a photoreceptor which has a flash exposure image plane.

The preferred embodiment of the present invention contemplates the cooperative use of a recirculating type document handling apparatus which provides for exposure of each side of a document sheet twice while on the platen and transports that sheet back onto a document stack while feeding a succeeding sheet from the bottom of the stack, onto the platen, and so on.

In the preferred embodiment of the invention, the form of document handling apparatus is used which will provide simplex to simplex, simplex to duplex, and duplex to duplex modes of copying. A document handling apparatus which may be used in the present invention is described in U.S. Pat. No. 4,411,517, commonly assigned and which is incorporated herein by reference. A copy sheet processor of the type utilized in the 9200® Duplicator, except as modified in accordance with the present invention, utilizes a transfer roller having means to retain a copy sheet thereon to receive two images in a copy technique called single pass processing. The present invention is a modification of the double flash exposing/copying arrangement disclosed in the copending patent application Ser. No. 564,584, commonly assigned and filed concurrently herewith.

The present invention includes a finishing arrangement for binding copy sheets received in succession at a sheet collecting device, comprising a pair of collecting trays each with an inlet on one side for receiving individual sheets from a sheet transport. The transport conveys each copy sheet to the trays in succession at a fixed loading position and a diverter gate oscillates between the trays for directing the sheets alternately. A pivotal set transport means is also provided for each tray for removing each completed copy set from the trays alternately at an unloading position on the other side of the trays from the sheet receiving loading position. When a tray receives the last sheet of a set being produced, the set transport associated therewith is activated to grip an edge of the set, to remove the same from the tray, and to transport the same to a binding device. Immediately after this operation, the other set transport performs the same operation on the other tray which at this time has received the last sheet of this set. Simultaneous with this operation, the first tray is receiving the first sheet.

A dual flash exposure scheme for a copier is broadly disclosed in the Research Bulletin No. 19015, Page 61, dated February 1980. This disclosure is limited to only the concept of dual flash exposure and a dual collecting tray arrangement. The scheme is not applied to duplex document handling nor to duplex copy sheet production in a single pass copying system. There is a complete lack of implementation as to the accomplishment of any facet of the broad concept especially in the handling of copy sheets during processing. No mention is made as to the handling of collected copy sets nor of effecting binding without losing the effect of dual flash exposure.

It is therefore the principal object of the present invention to produce bound sets or stacks of copies of a multi-page document at the highest speed possible for a reproduction machine.

It is a further object of the present invention to maintain full productivity in a reproduction/finishing system by minimizing or eliminating those machine copy cycle pitches which would be wasted during some machine operating steps such as document handling and copy set transporting.

It is another object of the present invention to minimize the number of moving parts in a document handling apparatus and finishing station and to reduce the number of movements usually incurred during the operation thereof.

While the present invention is disclosed in combination with a reproduction machine of the electrostatographic type, it will be understood that the disclosed precollating finishing system may be combined with other printing apparatus or machines which merely sort, collect and/or effect the movement of informational items such as sheets or cards.

Other objects and advantages will be apparent from the ensuing description and drawings wherein.

Figure 1:
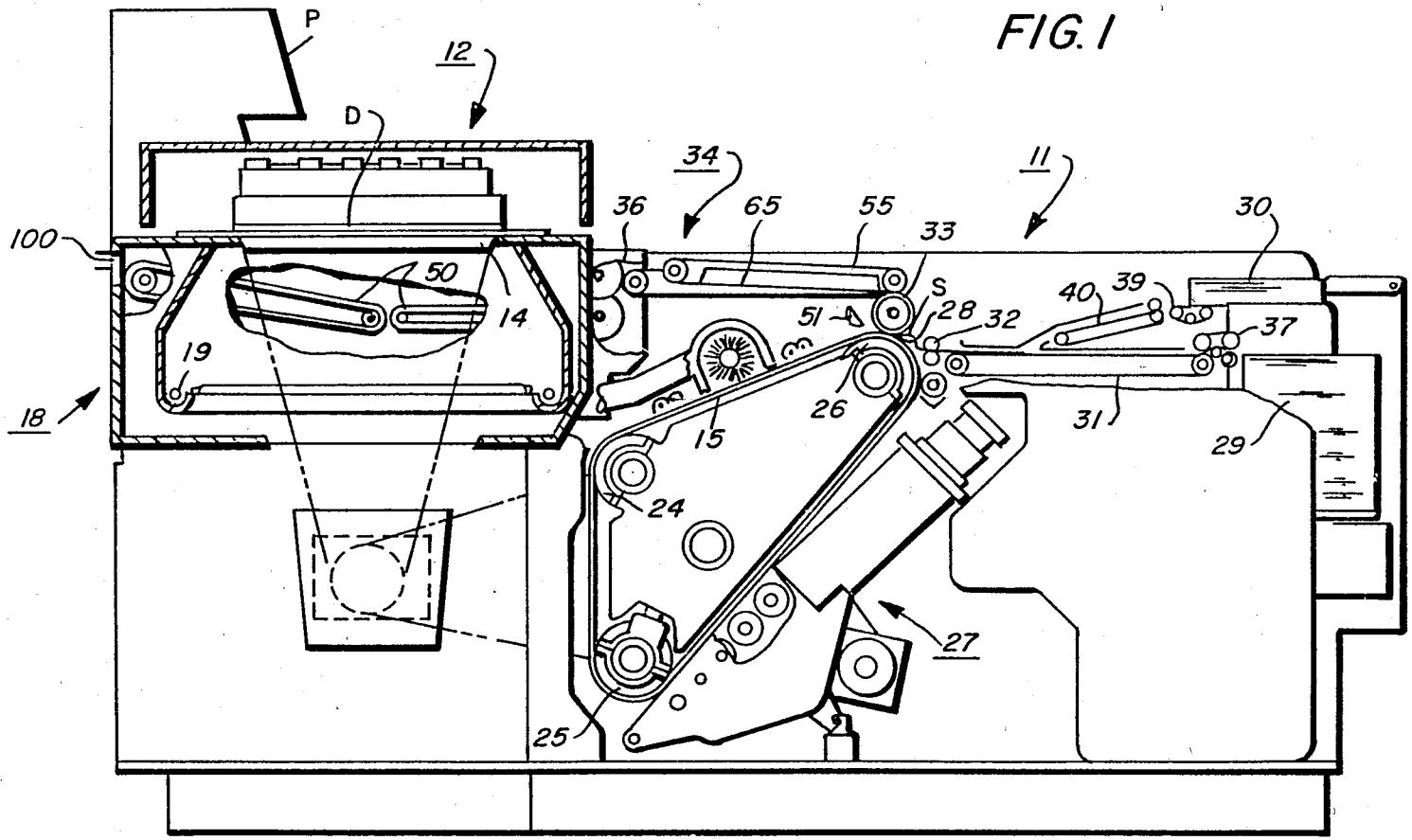
FIG. 1 is a schematic illustration of a configuration of an electrostatographic printing/finishing system employing the present invention.

For a general understanding of a reproduction machine with which the present invention may be incorporated, reference is made to FIG. 1 for the preferred embodiment of the invention wherein some components of a typical electrostatographic printing system are illustrated. The printing system shown is of the xerographic type as one including a xerographic processor 11, and a document handling apparatus 12. The apparatus may be of the recirculating type wherein an exposure is made of one side of document sheet which is then removed, either to present a succeeding document sheet to be applied to an exposure station, or the first document sheet is immediately inverted to permit exposure of the second side. In this embodiment, the processor 11 is, except for modifications to be described hereinafter, the same as the processor in the commercial embodiment of the Xerox 9500® Duplicator, which utilizes flash, full frame exposure for very high speed production. Document sheet exposure, image processing and copy sheet transport/handling are under control by a machine programmer and are effected in timed sequence, and in accordance with the program an operator has preset in the machine. Further details in this regard are not necessary since the Xerox 9500® Duplicator operates in this manner and is well known.

Except for modifications to be described below, details of the timing relationships, the programmer, and related structure and events are described in U.S. Pat. Nos. 3,790,270; 3,796,486; and 3,917,396, commonly assigned and which are incorporated herein by reference. A document handling apparatus which may be used in the present invention is described in U.S. Pat. No. 4,411,517 commonly assigned and which is incorporated herein by reference. The distinctions in the document handling apparatus contemplated in the present invention from that disclosed in this patent is that in the present invention, dual flash exposure is provided for each side of a document sheet, and that for duplex document sheet to duplex copy sheet copying mode of operation, each document sheet is inverted immediately after exposure to achieve exposure of both sides. It will be understood that most any other type of xerographic processor which has full frame, flash exposure and any recirculating or other type document handling apparatus may be utilized. Operating in conjunction with the processor 11 and apparatus 12 is a finishing station 13 and thereby forms the reproduction system shown in FIG. 1.

The system comprising the processor 11, the document handling apparatus 12, and the finishing station 13 (see FIG. 4), is under control of a programmer P which permits an operator various options: to turn the entire system ON or OFF; to program the reproduction system for a desired number of reproductions to be made of each original document sheet or set; to select whether simplex or duplex copies are to be made; to select a desired output arrangement, that is, sets mode or stacks mode, stapled or unstapled; to select one of a plurality of paper trays; to condition the machine for the type of document, that is, whether one sided or two sided, to select a copy size reduction mode, copy quality parameters, specialty features, and other desirable functions. The programmer P also includes a controller which provides all operational timing and synchronization between the processor 11 and all of its xerographic processing functions, and system control functions, the automatic events to be described hereinafter. The controller may include any suitable microprocessor having a CPU and the appropriate machine clock, but preferably the microprocessor is one similar to the Intel 8080 family of microprocessors manufactured by the Intel Corporation, Santa Clara, Calif., and having sufficient ROM and RAM for all of the necessary functions in the reproduction system.

The processor 11 includes an exposure station at which a document sheet to be reproduced is positioned on a glass exposure platen 14 for projection onto a photosensitive surface in the form of a xerographic belt 15. The set of individual document sheets are selectively transported by the document handling apparatus 12 one document sheet at a time to the platen 14 for exposure. After dual exposure of each document sheet is made, the same is returned to the top of the set or stack for simplex mode of copying or is turned over for exposure on the back side and returned to the top of the set until the entire set has been copied, whereupon the procedure starts again for a preset number of times depending upon the number of copy sets to be produced.

Imaging light rays from each of the document sheets are flash illuminated by an illumination system 18 having lamps 19 connected to a suitable flashing circuit (not shown) under control by the programmer P in timed sequence, and in accordance with the program the operator has preset in the machine. Further details in this regard are not necessary since the well known Xerox 9500° reproduction machine operates in this manner, and such arrangement is disclosed in U.S. Pat. No. 4,062,061. The xerographic belt 15 is mounted for movement around three parallel arranged rollers 24, 25, 26 suitably mounted in the processor 11. The belt is continuously driven by a suitable motor (not shown) and at an appropriate speed. The exposure of the belt to the imaging light rays from a document sheet discharges the photoconductive layer in the area struck by light whereby there remains on the belt an electrostatic latent image corresponding to the light image projected from the document. As the belt continues its movement, the electrostatic latent image passes a developing station at which there is positioned a developer apparatus 27 for developing the electrostatic latent image.

After development, the powdered image is moved to an image transfer station 28 where the developed image is transferred to a support surface, normally a sheet of copy paper, brought from a main or auxiliary paper tray 29, 30, respectively, as will appear. Each sheet is conveyed to the transfer station by a conveyor 31 which cooperates with sheet preregistration pinch rollers 32. These rollers are in driving contact to produce a nip whereat each sheet is preregistered prior to reaching the transfer station 28. Further details of the timing relationships and related structure and events are described in U.S. Pat. Nos. 3,790,270; 3,796,486; 3,917,396; and 4,062,061.

Each sheet is moved in synchronism with the movement of the belt 15, and passes between a transfer roller 33 and the belt 15 at the transfer station. After transfer, the sheet of paper is stripped off the belt 15 and transported by a vacuum conveyor 34, having one or more perforated belts 35, in an inverted condition to a fusing station where a fuser device 36 is positioned to receive the sheet of paper for fusing the powder thereon. After fusing, the sheet is transported to the finishing station 13.

As previously stated, copy sheets are supplied from either the main paper tray 29 or the auxiliary paper tray 30. Main paper tray 29 may include a suitable elevator type base on which a supply of sheets rest, the base being supported for automatic up and down movement by suitable means (not shown). Such movement being arranged to maintain a top-feeding sheet feed mechanism 37 in operative contact with the topmost one of the sheets on a stack arranged on a suitable elevator. The sheet feed 37 is operated intermittently in timed relationship to spacing of images on the photoreceptor belt 15 under control of the programmer P, and serves to advance the topmost sheet from the supply stack 29 to the main paper supply transport 31.

The auxiliary tray 30, in the exemplary arrangement shown, is arranged above main tray 29 and includes an air floatation baseplate upon which a supply of sheets may be placed. A bottom-feeding, sheet feed mechanism 39 is positioned for feeding sheets from the bottom of the stack of sheets thereon. Assisting in this feeding operation is an air floatation system, not shown, which substantially reduces the weight of the stack to permit easy withdrawal of sheets from the bottom. The sheet feed mechanism 39, which is intermittently driven in the same manner as the main tray feed mechanism 37, advances one sheet at a time to an auxiliary paper supply transport 40. The transport 40 is suitably driven by a drive system (not shown) and is disposed to discharge sheets drawn from auxiliary tray 30 onto the operating run of main supply transport 31. The sheets from auxiliary tray 30 are thereafter directed to the preregistration rollers 32.

During operation, if the reproduction system is preset for simplex copying, copy sheets leaving the processor 11 after exiting the transfer station 28, are conveyed directly to the fuser apparatus 36 and to the finishing station 13 by way of transports 50.

The present invention is applicable to simplex or duplex mode of copying. However, for duplex to duplex copying with a document handling apparatus described above, wherein document sheets are inverted to present side two of each document sheet to the exposure platen immediately after side one of the same sheet has been exposed twice, the copy sheet processor must also be capable of inverting copy sheets in accordance with this document sheet handling. For duplex document sheets, exposure occurs twice, first for one side of a sheet and then twice for the other side, this operation being repeated for each document sheet, in order to produce on a photoreceptor successive or side-by-side images corresponding to the pages of a document in numerical sequence either in increasing or decreasing order. For simplex document sheets, exposure occurs twice for each document sheet for the side bearing information or data to be copied.

To achieve single pass duplex, copying or processing, developed images are transferred to both sides of a copy sheet of paper successively upon passage of the sheet once through the processor 11. To this end, the transfer roller 33 is devised so that a sheet of paper may be transported through the transfer station in the normal manner for the transfer of a first image on one side of the sheet and then be gripped and held thereon to receive the sheet a second time, in an inverted orientation for the transfer of a second image on the other side of the sheet. A suitable tackifying device 51 is positioned after the transfer station 28 to tackify the toner images on the facing side of copy sheets passing therealong in order to preserve the image as the same is placed on and travels with the roller 33. Further details of the single pass duplex system so far described is adequately disclosed in U.S. Pat. No. 4,431,303, the disclosure of which is incorporated by reference herein. However, in the disclosure of this patent application, only one exposure of a document sheet is performed at a time and, therefore, only one copy sheet is handled by the transfer roller at a time.

Figure 2:
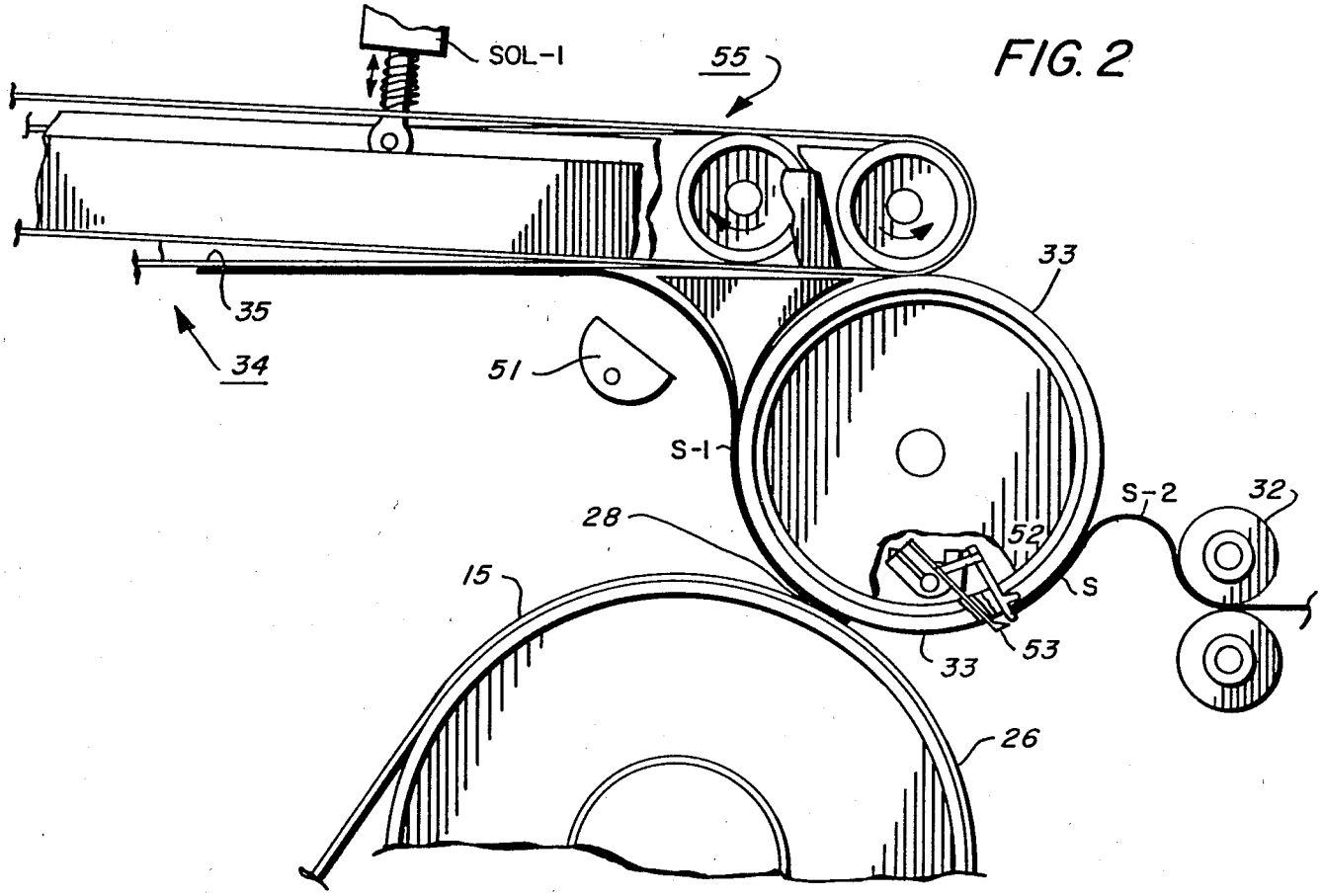
FIG. 2 is a partial elevational view, in section, showing a copy sheet processing arrangement.

As shown in FIG. 2, the transfer roller 33, in serving as an image transfer arrangement, is capable of registering and supporting a sheet of paper for either one transfer cycle for the simplex mode of copying or for two transfer cycles relative to the same sheet for the duplex mode of copying. To effect precise registration and positioning of sheets of paper upon the roller 33, there is provided a plurality of registration elements 52 mounted within and for movement radially of the roller. The elements 52 extend through openings formed in the periphery of the drum surface, the openings being in a line parallel to the axis of the roller. When in use, the leading edge of a sheet S (see FIG. 1) engages the elements 52 against which the edge will be held during handling of the sheet.

In operation, the elements 52 are adapted to assume three positions: the first, when no sheet is being transported, the elements occupy their innermost position, the second, in a slightly outward position when a sheet has been registered as shown in FIG. 2, and third, at a slightly greater distance from the periphery so as to move the leading edge of the sheet away from the roller surface to permit sheet stripout.

Operating in close conjunction with the registration elements 52 are a plurality of gripper fingers 53 which are secured to the shaft 55 by means of suitable fasteners and which extend through openings 61 formed in the periphery of the roller 33 adjacent the openings for the elements 52. The gripper fingers 53 are utilized to grip the leading edge of a sheet of paper as the same as fed to the nip formed between the roller 33 and the belt 15. Further details of the actuating mechanisms within the roller 33 for actuating the registration elements 52 and the gripper fingers 53 are unnecessary for understanding and utilizing the present invention.

Further details regarding the above described transfer roller and sheet registration and gripping actuating devices are found in the above referred to U.S. Pat. No. 4,431,303. As described in the foregoing cited patent, the actuation of the registration elements and gripper fingers 53 is achieved during rotation of the transfer roller under control by the energization of a solenoid. As a sheet is fed by either of the feeders 29, 30 in timed relationship with developed image on the belt 15, the leading edge is first pre-registered by the rollers 32, then are registered by the elements 52 when the same have been actuated to an outer position.

As the elements 52 are retracted with the leading edge of the sheet resting thereagainst, the gripper fingers 53 are actuated to their retracted position upon the leading edge to grip the same and both the elements 52 and the fingers 53 are further retracted so as to position these members so that they do not extend beyond the periphery of the roller 33 during rolling contact thereof with the belt 15. The fingers 53 are radially outward prior to the contacting of a leading edge of a sheet against the elements 52 to register the sheet. Continued rotation of the roller 33 to bring the sheet into the transfer nip at the transfer station 28 will coincide with the gripping of the leading edge of the sheet by the fingers 53. The fingers and elements 52 are then retracted to their most innermost position as the leading edge comes into the station 28.

As previously stated, copy sheets which have been completed as to receiving transferred images during either simplex or duplex mode of operation are conveyed to the fuser apparatus 36 by way of the vacuum transport 34. As disclosed in the above referred to patent application, a second transport 55, having transport belts moving in the opposite direction as those of the transport 34, is activated by energization of solenoid SOL-1 to rotate the transport 55 downwardly into contact with the copy sheets thereby when activated, to reversing the direction of movement of copy sheets after each has received a first transferred image on one side. This reversal causes the trailing edge of the sheet to become a leading edge, to be registered by the elements 52 and be gripped by the fingers 53 as the same are in a position 180° from that shown in FIG. 2. In this manner, the side-by-side duplicate sheets are transported once again to the transfer station whereat a second image is transferred on the back side of the sheet. A suitable tackifying device is contemplated in this arrangement for tackifying the transferred images on the side of the copy sheets facing the roller 33 and the transport 55 to prevent degrading of unfused toner images on that side.

As previously stated, the present invention contemplates a variation in operation from that described in the above referred to patent application in that two copy sheets are being handled in succession, or in side-by-side relationship by the transports 34 and 55 and the transfer roller 33. Since the present invention contemplates that one side of a document sheet for simplex copying or both sides of the sheet for duplex copying will be flash exposed in dual sequence, two side-by-side or successive copy sheets will be transported through the transfer station 28 for the corresponding first image and then both copy sheets returned to the transfer station for receiving the second corresponding images, if duplex copying has been selected. In order to accomplish the handling of two successive copy sheets at a time, the reversing transport 55 must be made to accommodate two copy sheets and appropriate spacing between the sheets at the same time.

In this operation, the fingers 53 will grip the leading edge of the first sheet until the edge has been carried through the transfer nip whereupon a release of the edge occurs so that the sheet may be picked up by the transport 34 for further transporting. This is illustrated in FIG. 2 by the sheet S-1. As the trailing edge of sheet S-1 leaves the transfer nip, the registration elements 52 and 53 are in position to receive the leading edge of the second copy sheet S-2 which is spaced a short distance between sheet S-1. The same transporting of sheet S-2 is performed until both sheets are on the belts 35 of the transport 34 whereupon the transport 55 is immediately activated downwardly slightly to reverse the direction of movement of both sheets. As the trailing edge of the second sheet S-2 moves in reverse, it immediately becomes gripped by the fingers 53 which are now in the 180° position from that shown in FIG. 2.

The second side of the second sheet is brought back to the transfer station to receive the second side image, and as the fingers 53 reach their upper position again they will operate on the trailing edge of the first sheet S-1 to perform similar operations. When the second sheet has received its second image, and the first sheet is receiving its second side image, such as being in the position of sheet S-1 in FIG. 2, elements 52 and fingers 53 are in position to receive the copy sheets for the next document sheet to be copied in the duplex mode, and so on. In the duplex copying mode, one machine pitch or cycle is lost after every two duplex copy sheets, that is, for every four image copies or transfers in the duplex mode of copying, one machine cycle is lost. Further details of the processing devices and stations in the printer system or processor are not necessary to understand the principles of the present invention. However, a detailed description of these processing stations and components along with the other structures of the machine printer are disclosed in U.S. Pat. No. 4,054,380 which is commonly assigned with the present invention and which is incorporated by reference herein.

The structural arrangement of the document handling apparatus 12 is disclosed in the above referred to U.S. Pat. No. 4,411,571 which normally operates to feed one document sheet D at a time from a supply of document sheets into copying position on the platen 14 where normally a single exposure of a side of a document sheet is made. This single exposure at a time results in the production of copies at one-half the rate of production to which the processor 11 is adapted and the sequence of document handling is: flash exposure, skip pitch (for belt 79 reversal), flash exposure, skip pitch (for belt 79 reversal), and so on. Following this exposure, the document sheet is automatically returned to the document supply and the next document sheet, if any, is brought into the exposure position on the platen 14. Document sheets returned to the supply stack may be recycled any number of times, depending upon the desired number of copy sets to be produced by the apparatus 12 or simply removed by the user when the copying program is completed. Since the structural details of the particular document apparatus 12 is disclosed in the above referred to U.S. Pat. No. 4,411,517, further structural description thereof will not be included herein.

In the present invention, however, only the structural embodiment of the indicated document handling apparatus is utilized and its control and operation is such that each time a document sheet is presented to the exposure platen, two flash exposures of a side of a document sheet are made instead of the normal single flash exposure. With this arrangement, higher productivity is available by the document handling apparatus which now has a sequence of flash exposure, flash exposure, skip pitch (for belt 79 reversal), flash exposure, flash exposure, skip pitch (for belt 79 reversal), and so on.

Figure 3:
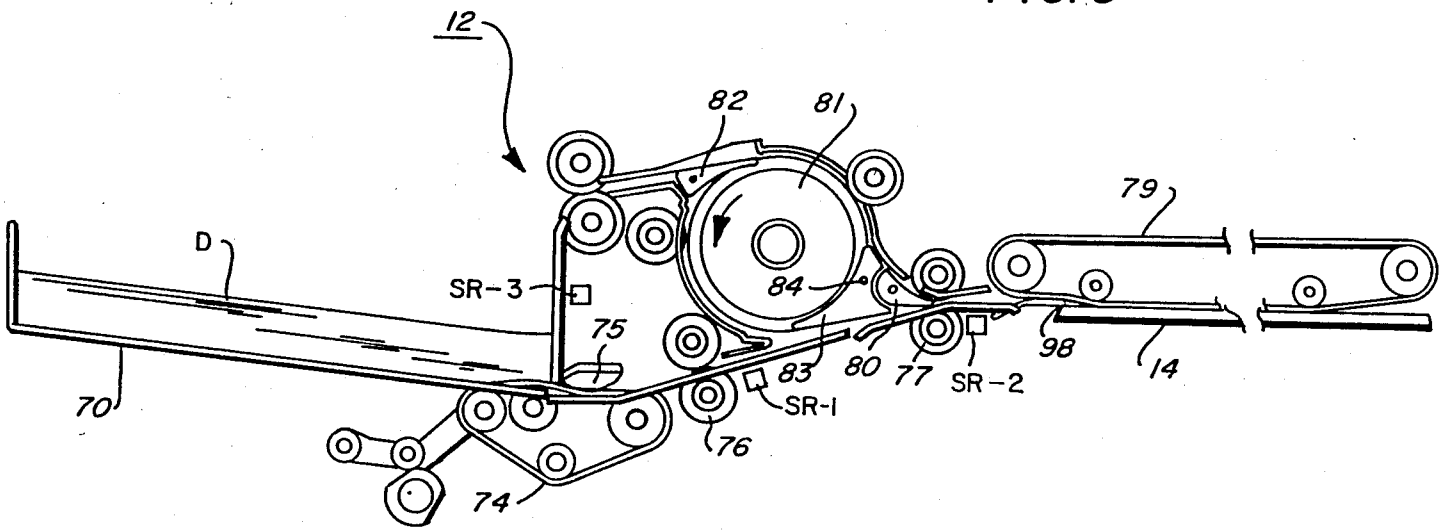
FIG. 3 is an elevational view, partly in section, of the preferred embodiment of a document handling apparatus utilized in the system.

As shown in FIG. 3, the document handling apparatus 12, in accordance with the present invention, serves to feed one document sheet at a time from a supply of document sheets D into copying position on the platen 14 where a single exposure is made, if only one copy set is programmed, or two exposures at a time are made if a plurality of copy sets are to be produced. Following exposure one or more times, each document sheet is automatically returned to the document supply and the next document sheet, if any, is brought into the exposure position on plate 14. It will be understood that document sheets returned to the supply stack may be recycled by the apparatus 12 or simply removed by the user when the copying program is completed.

The document handling apparatus 12 includes a sheet support means or tray 70 for supporting a stack of document sheets D. A document separator feed belt 74 is rotatably supported and driven around a roller positioned below the leading edge of the stack D so that a portion of the belt 74 is free to lift the leading edge of the stack D. Lifting action is accomplished by the timing action of the programmer P which effectively forces the belt 74 in friction engagement with the bottom document sheet to feed the same forward. This document feed operation drives the document sheet along with the belt and between the same and a retard pad 75 which is normally in contact with the belt. The pad 75 insures that only one document sheet at a time is fed and serves to hold back any other sheet above the sheet being fed.

The sheet continues to be fed until the leading edge thereof is driven to the nip of feed roller pair 76 which defines a wait station whereat the sheet is held, since at this time this roller pair is not in rotation and forward feeding of the sheet is terminated. A wait station sensor SR-1 senses the presence of a document sheet and conveys this data to the programmer P in order to initiate rotation of the roller pair by a suitable drive thereby.

The resultant drive of the document sheet moves the same into the nip of an on/off drive roller pair 77. The latter roll pair continues moving the document sheet over the registration member or gate 98 and onto the exposure platen 14 where further movement thereon is pushed up by a document belt 79. This belt transports the document sheet fully upon the platen and slightly beyond the edge of the registration gate 98, the edge being slightly above the plate of the platen.

By a suitable program in the logic of the programmer P, the transport belt 79 is then reversed to produce reverse movement of the document sheet until the trailing edge thereof abuts the gate 98 thereby effecting registration of the document sheet. The system logic then produces two exposures of the side of the sheet on the platen 14. Upon this occurrence, the transport belt 79 commences its reverse drive movement at the same time the registration member 98 has been retracted below the plane of the platen, permitting the document sheet to be transported off the platen 14.

As the document sheet leaves the platen area, its movement is picked up by the roller pair 77 now rotating in the reverse direction from that which delivered the sheet to the platen area. In leaving the platen area, the sheet is directed upwardly by a gate 80 which now has been deflected or turned clockwise about its pivot. The sheet is conveyed by the roller pair 77 upon the gate 80 and onto a rotating turnaround drum 81. A series of rollers extend into this arcuate space to be in contact with the drum surface for transporting the sheet further along the drum. In leaving the platen area, the exiting of the document sheet is sensed by an exit sensor SR-2 to provide the Programmer with this data.

As the document sheet is carried around the turnaround drum 81, it reaches a pivotable duplex gate 82 to be directed thereby either back into the tray 70, if simplex documents are being copied, or completely around the drum and back onto the platen 14 if duplex document sheets are being copied. If the simplex mode has been selected, the gate 82 is rocked in a clockwise rotation to permit a document sheet to move thereover and into the document tray 70 with the same page orientation as it had before being fed from the tray. This document sheet is so placed upon the stack of other document sheets to await its turn again to be fed to the platen to be copied as before. A return sensor SR-3 senses the return of the sheet as data for the programmer P as part of the copy count program.

For simplex to simplex and simplex to duplex copying, the document sheets are placed in the tray 70, face down, that is, page one is on and faces the bottom of the tray and the last page of the stack is on top, a N-1 arrangement. For duplex to simplex or duplex to duplex copying, the document sheets are placed face up, with page one of sheet one on the top of the stack, a 1-N arrangement. These orientations of document sheets may be made such that for all modes of copying, the preferred 1-N arrangement is utilized. However, in this event sheet reversal/inversion may be utilized in the document apparatus and perhaps in the copy sheet exit path in order to insure original and proper orientation of the document sheets and the copy sheets when a run is completed. No further details need be specified herein in this regard since the need for and use of sheet reversers/inverters are within the skill of the art.

In any event, if the duplex mode of operation has been selected and the stack of document sheets have been placed in the tray face up as customary, the duplex gate 82 is rocked in a counterclockwise rotation to permit the sheet to be driven thereunder and into continued driving movement by a series of suitable rollers. The document sheet once again is driven below the gate 80 which has previously been rotated by the machine logic to permit this movement of the document sheet. Once again, the sheet is positioned upon the platen 14 by the combined action of the on/off drive roller pair 77 and the transport belt 79. In this sequence however, the document sheet had been inverted to bring the other side thereof (side one or odd side) upon the platen for two exposures.

Assuming that the even side of the sheet, say page two, was the first side to be double exposed in the previous copying exposures, now page one of this sheet is upon the platen for two copying exposures. After these exposures have been completed, the document sheet is returned to the tray 70 as was the case for a simplex document sheet as described above. In this case however, the odd side of the sheet, or page one, becomes oriented in the tray face down. It will be seen then that for a set of duplex document sheets being copied in this manner, the odd sides of the sheets would all be oriented in the face down position, so that the tray will not present the proper sequence of papers in a document set as was the case when the document sheets were initially placed in the tray.

In order to reorient the numerical sequence of document sheets after all of the document sheets have been copied without another copying pass, the set of sheets are circulated individually around the turnaround drum 81 in order to place the odd numbered document pages in their original face up position. In these positions, the document sheets in a set are disposed for another circulation into copying position. The re-orientation is under control of the programmer P after the return sensor SR-3 has indicated that a document sheet has been returned to the tray 70, presumably the last sheet, and this data is compared to the number of document sheets in the set. With this arrangement, maximum throughput is achieved and only one machine pitch or copy cycle is lost during a change in document sheets. This is accomplished by timing events so that a document sheet is travelling over the drum 81 on its return to the tray 70 while another document sheet is being placed on the platen 14.

Circulation of the document sheets around the turnaround drum 81 for re-orienting the same, as described in the preceding paragraph is effected by programmed rotation of a gate 83 about its pivot axis 84. When this circulation procedure has been activated, document sheets are bottom fed from the tray 70, as was the case during the ordinary copying mode of operation, by the now actuated feed belt 74 working in conjunction with the retard pad 75. The sheets are transported by the roll pair 76 to across the arcuate top surface of the gate 83, previously pivoted in a counterclockwise direction to permit this deflection. During this operation, the function of the wait station sensor SR-1 and the on/off operation of the roll pair 76 is inhibited in order to permit very rapid circulation of the document sheets from the tray 70, around the turnaround drum 81 and back into the tray in the shortest time possible in order to minimize loss of productivity. At the termination of this circulation of document sheets, as determined by the sensing of the last sheet by the return sensor SR-3 when compared to the document sheet count, the document handling apparatus 12 is again ready for another cycle of copying. After the document sheets have been re-oriented, the gate 83 is rocked to its normal position as shown in FIG. 3 preparatory to another copying cycle. Further structural details are not necessary for understanding the present invention as this structure is described in the above referred to U.S. Pat. No. 4,411,517.

From the foregoing description of the document apparatus 12, it will be understood that sequencing and throughput of document handling by the apparatus 12 is synchronized and equivalent to copy sheet handling by the apparatus disclosed in FIG. 2. The throughput of the apparatus 12 in the duplex document sheet to duplex copy sheet mode of operation is such that only one machine pitch is lost in every three successive machine pitches. For example, the machine controller is programmed to copy one side of a first document sheet twice in two pitches, skip a pitch while the document sheet is inverted, and returned, copy the other side of the document sheet twice with the next two pitches, skip a pitch as the next document sheet is placed on the platen and reversed for registration, copy the first side of the next document sheet twice in the next two pitches, skip a pitch while inverting this next document sheet, copy the opposite side of this next document sheet, and so on. It will be appreciated that this loss of one copy cycle pitch out of three copy cycle pitches is a significant improvement over the loss of one pitch out of two pitches which may be possible from the apparatus disclosed in the above referred to U.S. Pat. Nos. 4,258,500; 4,176,945; and 4,192,607. Equally important, however, is that in the present invention, higher speed machines may be employed for the equivalent wear and tear.

Figure 4:
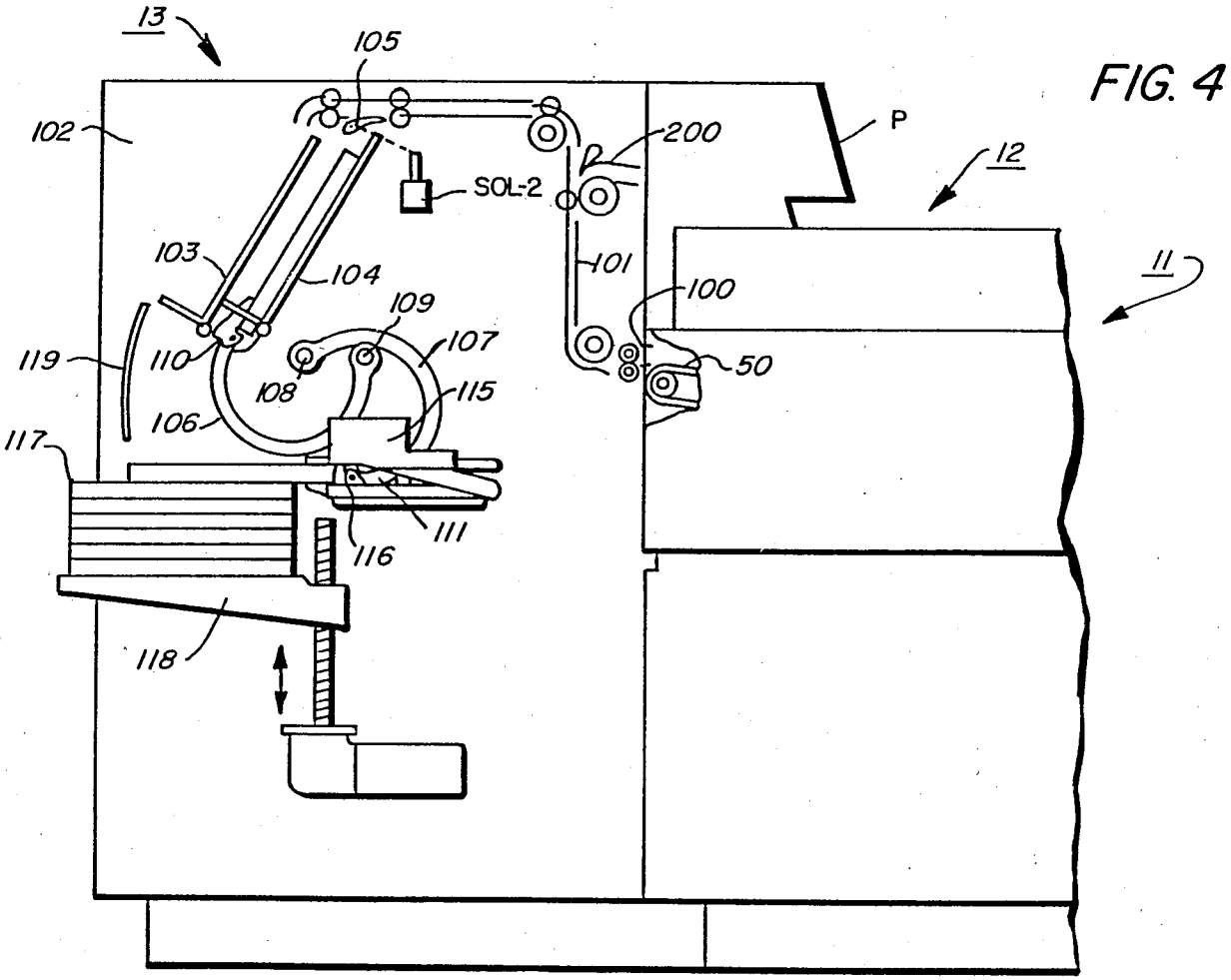
FIG. 4 is a schematic illustration of a finishing station utilized in the present invention.

As shown in FIG. 4, the finishing station 13 is arranged on one side of the processor 11 whereat copy sheets, either simplex or duplex are exited through a slot 100. A suitable transport 101 carries the sheets vertically upward and then horizontally to a two bin compiler system 102 comprising bins 103, 104. A sheet deflector 105 pivotal in one direction by a solenoid SOL-2, directs copy sheets in one bin and pivotal in the other direction directs copy sheets in the other bin. The bins 103, 104 are positioned at approximately 30° to the vertical and as the copy sheets are collected therein, they become registered by means of the bottom wall of the bins. Suitable joggers or scuffers (not shown) may be incorporated in each of the bins to insure good quality corner registration.

A pivotal set transport 106 is in cooperative relationship with the bin 103 and a second pivotal set transport 107 is in cooperative relationship with the bin 104. The set transports 106, 107 are pivoted at pivot points 108, 109, respectively, and include power actuated clamps 110, 111 which serve to grip the lower registered edge of a complete copy set from their respectively associated bin and to transport the set to a finishing apparatus 115. The apparatus includes a pair of aligned staplers or stitcher assemblies arranged to apply one or two staples selectively along the gripped edge. Each of the set transports directs the gripped edge into the clamping device for the stapler or stitcher assemblies of the apparatus 115 whereat the edge is clamped, a staple or two or driven thereinto and clinching is performed to complete the finishing action in the conventional manner. The apparatus 115 may include a kicker mechanism 116 arranged to provide a short horizontal impulse to a bound copy set to move the same to and upon a stack 117 of finished copy sets being accumulated upon an elevator 118. A curved guide plate 119 is arranged above the stack to assist in guiding the trailing edge of each copy set being removed by a set transport and as the copy set is carried to the stack after a finishing operation.

While the foregoing description for the finishing of copy sets has been directed to staplers and stitchers, the present invention is not restricted thereto. The term finishing is used herein in its broad sense to include other forms of binding such as adhesive binding. In accordance therewith, the finishing apparatus 115 may also be in the form of an adhesive binder adapted to apply adhesive to the edge of a copy set.

As each of the two copy sheets, each bearing images on one or both sides after simplex or duplex document sheet double exposure and corresponding simplex or duplex copying as aforesaid, the sheets are conveyed by the transports 50 through the exit slot 100 and into the bins 103, 104 alternately. The solenoid SOL-2 for the deflector 105 is under control of the machine programmer to be actuated alternately so that the bins 103 receives the first copy sheet corresponding to the bottom document sheet in the tray 70 and the bin 104 receives the second sheet in the same orientation. In simplex copying, the first copy sheet will have its image side facing downwardly, and in duplex copying, the odd numbered side will face upwardly so that page 1 of a completed copy set faces upwardly. For the next set of two copy sheets produced in the duplex mode, the sheets will be placed alternately upon the preceding sheets in the bins with the odd page number on the upper side of the sheets, and so on. Assuming that the document in the apparatus 12 consists of five document sheets with each having both sides to be copied so that there are 10 numbered pages of to-be-copied data, the corresponding sheets will be collected in the bins 103, 104 starting with the surface having page 10 facing the bottom of the bins thereby leaving page 9 as the top surface, with page 8 as the lower surface of the second copy sheet, thereby leaving page 7 as the top surface of the second sheet, and so on.

Upon completion of the copy set in bin 103, the driving mechanism for the set transport 107 is immediately actuated even before the last sheet is fully positioned in bin 104. The copy set is transported to the apparatus 115 for finishing thereof and placed upon the collected set stack. During this action, the set transport 106 is actuated immediately after the last sheet enters the bin 104 and the copy set therein is transported to the finishing apparatus 115 for binding as was the first set. During this latter operation by the set transport 106, the bin 103 is receiving the first copy sheet of the third copy set to be produced. After the transport 106 has removed the copy set in the bin 104, the latter immediately receives the second copy sheet of the third copy set, and so on, the alternate operation of the set transports and the transporting of copy sheets to the bins are timed so that there is no loss of machine cycles and copy sheets are allowed to flow to the station 13 in a steady stream. The concept of the second set clamping and unloading and thereby holding or "buffering" a copy set while the first copy set is being finished in effect "buys time" to accomplishing finishing in two or three cycles.

By the utilization of two alternating set transports wherein each is operated in the time span of two or three machine cycles or pitches instead of for every machine cycle, very high speed copy set production can be maintained without subjecting mechanical parts to equivalent high speed movement which can result in increased wear and tear and jam incidences. The most significant contribution of the dual flash concept for which the present invention is embodied is to reduce document handling stress. In the example above, assuming 10 copy sets were programmed, each of the bins 103, 104 would have collected five sets and upon production of 10 completed and finished copy sets, all arranged in the stack 118, the system will revert to standby condition, as conventionally known.

Figure 5:
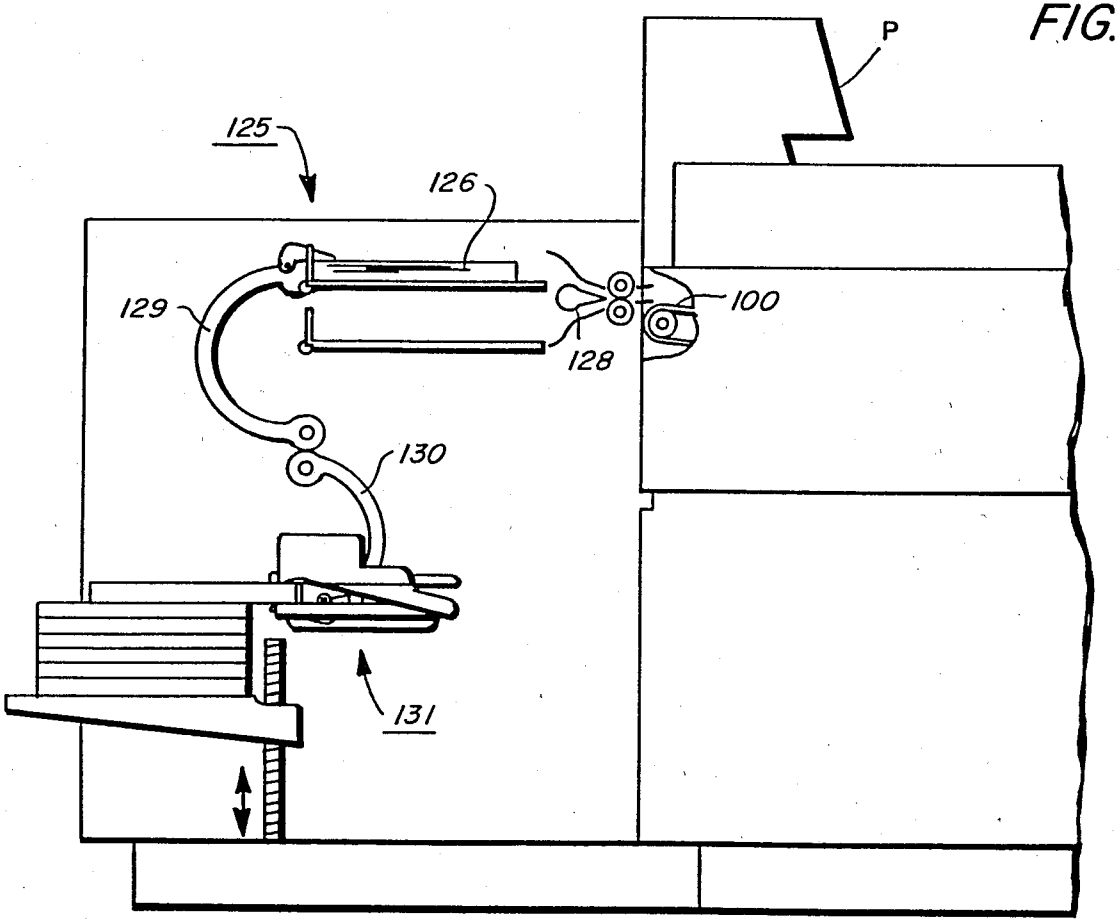
FIG. 5 is a schematic illustration of another embodiment of a finishing station.

Another embodiment of the finishing station to which the present invention may be applied is illustrated in FIG. 5. In this embodiment, the finishing station 125 comprises two collating or collecting bins 126, 127 arranged in horizontal planes, one above the other. A single deflector 128 is utilized, under control of the machine controller, to direct copy sheets alternately into the bins as each set of two identical copy sheets exit the slot 100. Suitable scuffers may be employed in each of the bins to effect corner registration. A pair of set transports 129, 130 are pivotally mounted in the station and a two stapler or stitcher assembly 131 is associated therewith. These devices all perform in the manner and the sequence described above for the embodiment of FIG. 4. Instead of the assembly 131, an adhesive binder may be employed for effecting finishing of the copy sets.

Figure 6:
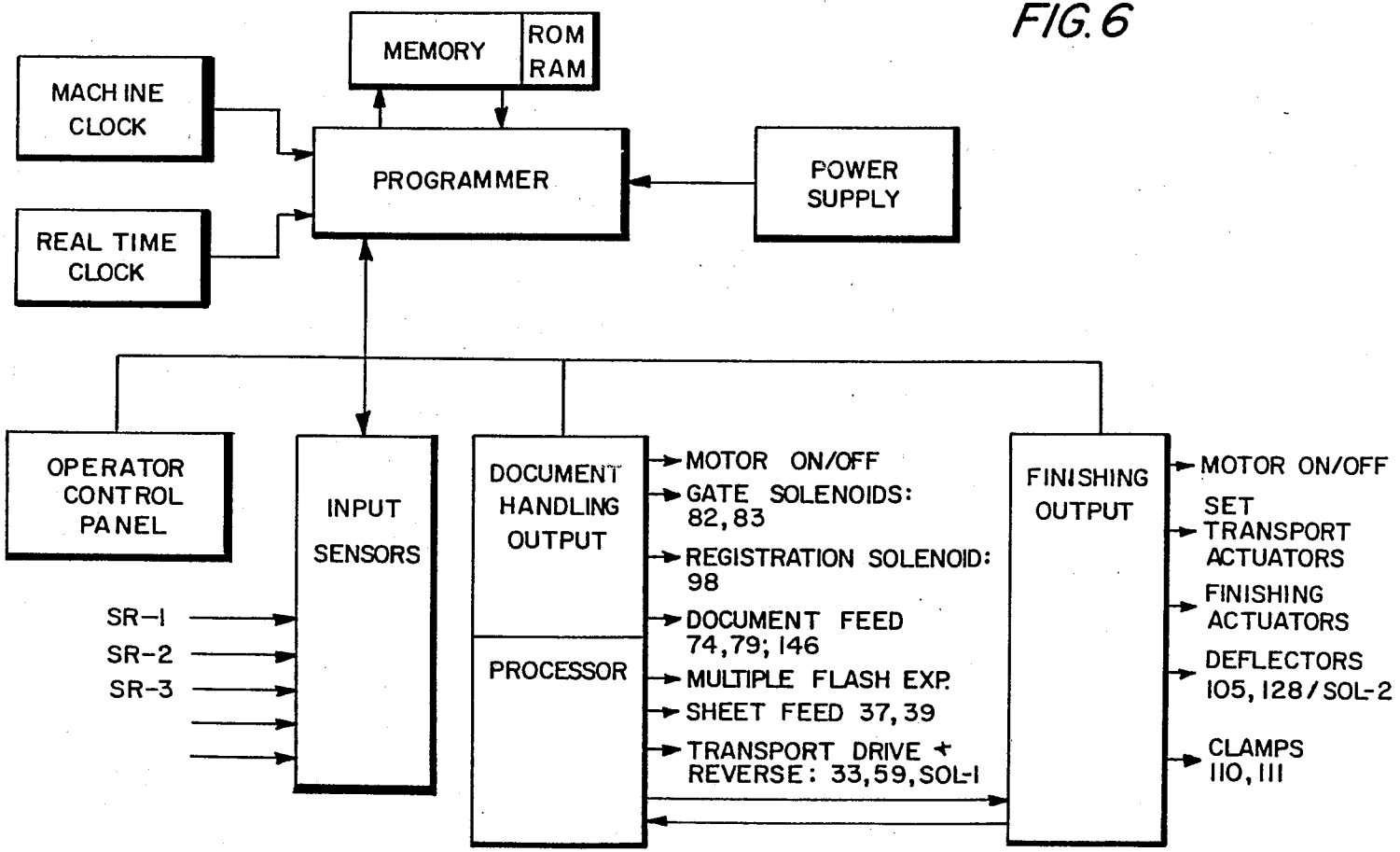
FIG. 6 is a block diagram of the control scheme for the various systems described herein.

The block diagram in FIG. 6 illustrates the relationship between the inputs and outputs for document handling, two tray collection and finishing in the foregoing description and the control arrangement therefor. While not shown as being unnecessary, the inputs and outputs for the processor 11 are also interrelated to the control arrangement. The block diagram depicts the cooperating action between the control components of the processor 11, the document apparatus 12 and the finishing apparatus 13.

While not preferred, other examples of automatic, on-line collating copiers/finishers having staplers, stitching, or adhesive binding devices, which may, with modifications in accordance with the present invention, be utilized with the present invention are disclosed in U.S. Pat. Nos. 4,328,919, 4,134,672 and the "Research Disclosure Journal", Publication Nos. 22733 and 22734, pages 120–134, March 1983. However, substantial revision would necessarily have to be made to provide at least the structural requirements to achieve the present invention. Examples of single pass copying in a processor are disclosed in U.S. Pat. Nos. 3,506,347 and 4,264,183.

Therefore, while the invention has been described in connection with particular arrangements and operations thereof, no limitation is intended thereby except as defined in the following claims.

I claim:

1. A reproduction system comprising:

a document handling apparatus adapted to transport individual document sheets from a supply stack to an exposure platen and effecting two exposures of each side of each document sheet and returning the same to the stack, a copy sheet processor having means for producing the information on each side of each document sheet onto one side of two side-by-side copy sheets, and to invert the two copy sheets immediately and produce the information on the other side of the document sheet onto the other side of the copy sheets, collating means arranged to receive the copy sheets from the processor and to collate the same into two copy sets alternately, each set being a reproduction of the document sheets in the document stack, and a finishing apparatus adapted to receive said copy sets alternately and to bind the sets.

2. The reproduction system of claim 1 wherein said finishing apparatus includes means for applying adhesive binding material to the sheets.

3. The method of producing bound sets of copy sheets of a set of document sheets comprising the steps of:

transporting each of said document sheets from a stack to an exposure position for an electrostatographic printing system and exposing one or both sides two times while each document sheet is at said position, processing two copy sheets side by side containing the information on each of the document sheets through the printing system, collating the copy sheets into sets alternately into each of two collecting trays, and transporting the completed collated sets of copy sheets from said trays to a binding apparatus alternately to be bound thereby whereby at least one of said trays is collating at least some of the copy sheets while the other tray is being unloaded.

4. The method of producing bound sets of copy sheets of a set of document sheets comprising the steps of:

transporting each of said document sheets from a stack to an exposure position for an electrostatographic printing system and exposing one side two times and then inverting the document sheet and exposing the other side two times, processing two successive copy sheets containing the information on each of said document sheets through the printing system immediately, collating the copy sheets into sets alternately into each of two collecting trays, and transporting the completed collated sets of copy sheets from said trays to a binding apparatus alternately to be bound thereby whereby at least one of said trays is collating at least some of the copy sheets while the other tray is being unloaded.

5. A reproduction system comprising:

a copy sheet processor having means for reproducing information from one side of each document sheet of a stack of document sheets onto one side of two successive copy sheets and for immediately inverting the document sheet and reproducing information from the other side of the document sheet onto the other side of the two successive copy sheets thereby effecting successive duplicate copies of each of the document sheets, collecting means arranged to receive the copy sheets from the processor and to collate the same into two copy sets, each being a reproduction of the document sheets in the document stack, means for transporting the copy sheet output of the processor and directing the same to form said two copy sets alternately, and a finishing apparatus adapted to receive said copy sets alternately and to bind the sets.

6. A reproduction system comprising:

a document handling apparatus adapted to transport individual document sheets from a supply stack to an exposure platen and effecting two exposures of each side of a document sheet before returning the same to the stack, a copy sheet processor having means for producing information on one side of the document sheet onto two successive copy sheets and immediately inverting the copy sheets and producing the information on the other side of the document sheet onto the other side of the two copy sheets, collecting means arranged to receive the copy sheets from the processor and to collate the same into two copy sets, each being a reproduction of the document sheets in the document stack, means for transporting the copy sheet output of the processor and directing the same to form said two copy sets alternately, and a finishing apparatus adapted to receive said copy sets alternately and to bind the sets.

7. An electrostatographic reproduction system comprising:

a document handling apparatus adapted to transport individual document sheets from a supply stack to an exposure platen and effecting two exposures of each side of a document sheet before returning the same to the stack, a copy sheet processor having an image fixing apparatus for fixing electrostatic toner images to copy sheets, said processor including means for producing information on one side of the document sheet onto two successive copy sheets and immediately inverting the copy sheets before the same are transported to said fixing apparatus and producing the information on the other side of the document sheet onto the other side of the two copy sheets, collecting means arranged to receive the copy sheets from the processor and to collate the same into two copy sets, each set being a reproduction of the document sheets in the document stack, means for transporting the copy sheet output of the processor and directing the same to form said two copy sets alternately, and a finishing apparatus adapted to receive said copy sets alternately and to bind the sets.

8. The method of producing bound sets of double-sided copy sheets of a set of single-side document sheets arranged in bottom to top numerical order in a stack, comprising the steps of:

(a) separating the bottom document sheet of the stack, and presenting the bottom side of the same to an exposure position for an electrostatographic printing system and exposing said bottom side at least two times;

(b) removing said bottom document sheet from said exposure station;

(c) transporting the bottom document sheet onto the top of the stack with the top side thereof facing upwardly;

(d) processing copy sheets containing the information on said bottom document sheet through the printing system;

(e) collating the copy sheets into sets alternately into each of two collecting trays, (f) repeating steps (a), (b), (c), (d), (e) for all of the remaining document sheets in the stack, and (g) transporting the completed collated sets of copy sheets from said trays to a binding apparatus alternately to be bound thereby whereby one of said trays is collating some of the copy sheets while the other tray is being unloaded.

9. The method of producing bound sets of double-sided copy sheets of a set of double sided document sheets arranged in top to bottom numerical order in a stack, comprising the steps of:

(a) separating the bottom document sheet of the stack, and presenting the bottom side of the same to an exposure position for an electrostatographic printing system and exposing said bottom side two times;

(b) removing said bottom document sheet from said exposure station and immediately presenting the top side of the same document sheet to said exposure position and exposing said top side two times;

(c) transporting the bottom document sheet onto the top of the stack with the bottom side thereof facing upwardly;

(d) processing copy sheets containing the information on said bottom document sheet through the printing system;

(e) collating the copy sheets into sets alternately into each of two collecting trays;

(f) repeating steps (a), (b), (c), (d), (e) for all of the remaining document sheets in the stack, and (g) transporting the completed collated sets of copy sheets from said trays to a binding apparatus alternately to be bound thereby whereby one of said trays is collating some of the copy sheets while the other tray is being unloaded.

* * * * *